US007389082B2

(12) United States Patent
Okamoto

(10) Patent No.: US 7,389,082 B2
(45) Date of Patent: Jun. 17, 2008

(54) METHOD AND APPARATUS FOR FORMING AN IMAGE HAVING UNIFORM GLOSSINESS

(75) Inventor: Yukio Okamoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 113 days.

(21) Appl. No.: 11/207,815

(22) Filed: Aug. 22, 2005

(65) Prior Publication Data

US 2006/0239729 A1 Oct. 26, 2006

(30) Foreign Application Priority Data

Apr. 21, 2005 (JP) ..... 2005-123283

(51) Int. Cl.
*G03G 15/20* (2006.01)

(52) U.S. Cl. ..... 399/342; 156/277; 399/320; 430/108.8; 430/124.52

(58) Field of Classification Search ..... 399/341, 399/342, 320, 328, 327; 347/156; 156/277; 430/124, 18, 42, 108.8, 108.1, 124.1, 124.52
See application file for complete search history.

(56) References Cited

U.S. PATENT DOCUMENTS

| | | | | |
|---|---|---|---|---|
| 4,891,677 | A * | 1/1990 | Shiozawa et al. | 399/342 X |
| 5,327,201 | A * | 7/1994 | Coleman et al. | 399/342 |
| 5,983,064 | A * | 11/1999 | Green et al. | 399/341 |
| 6,177,223 | B1 * | 1/2001 | Hashimoto et al. | 430/124 X |
| 6,663,238 | B2 * | 12/2003 | Kikuchi et al. | 156/277 X |
| 6,795,676 | B2 * | 9/2004 | Kikuchi et al. | 399/328 X |
| 6,980,763 | B2 * | 12/2005 | Murai et al. | 399/341 X |
| 6,985,691 | B2 * | 1/2006 | Kodera et al. | 399/341 |
| 7,056,638 | B1 * | 6/2006 | Tomita et al. | 430/108.8 |
| 7,079,802 | B2 * | 7/2006 | Katayanagi et al. | 399/331 |
| 2002/0118987 | A1 * | 8/2002 | Takekoshi | 399/342 |
| 2003/0027074 | A1 * | 2/2003 | Emoto et al. | 430/124 |
| 2003/0190180 | A1 * | 10/2003 | Katayanagi et al. | 399/406 |
| 2005/0019069 | A1 * | 1/2005 | Katayanagi et al. | 399/327 |
| 2005/0196206 | A1 * | 9/2005 | Arimura | 399/350 |
| 2006/0210907 | A1 * | 9/2006 | Egusa et al. | 430/124 |
| 2006/0251451 | A1 * | 11/2006 | Ishigami et al. | 399/328 |

* cited by examiner

*Primary Examiner*—Sophia S Chen
(74) *Attorney, Agent, or Firm*—Finnegan, Henderson, Farabow, Garrett & Dunner, L.L.P.

(57) ABSTRACT

An image forming method including the steps of a) forming a mirror image by a toner on a transparent substrate, and b) laminating the toner image carrying surface of the transparent substrate with a light reflecting material through a tacking layer or an adhering layer.

22 Claims, 5 Drawing Sheets

FIG. 8
REPLACEMENT SHEET
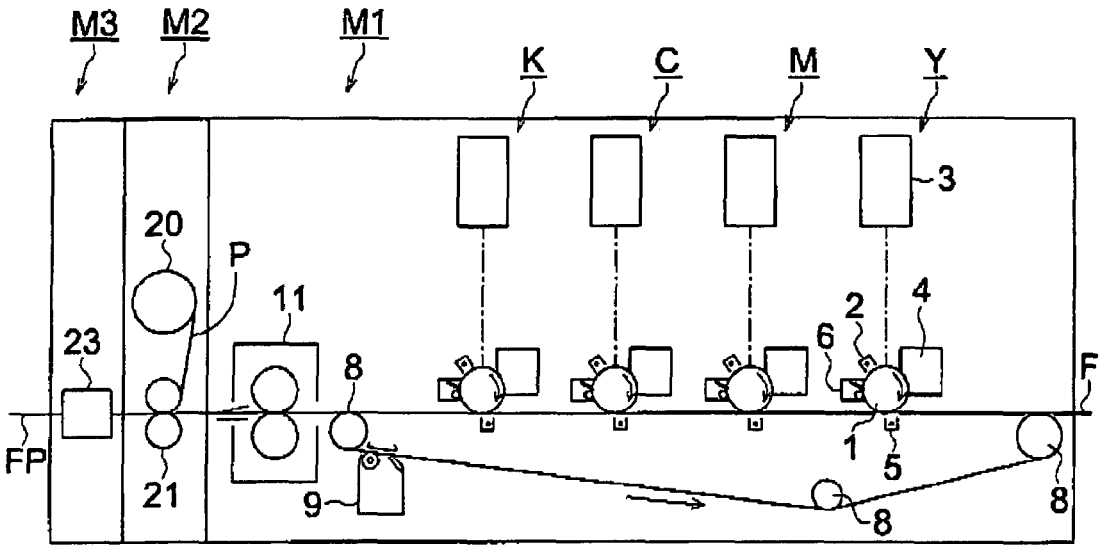

METHOD AND APPARATUS FOR FORMING AN IMAGE HAVING UNIFORM GLOSSINESS

BACKGROUND OF THE INVENTION

This invention relates to an image forming method and apparatus for forming a toner image at the interface of a transparent substrate and a light reflecting material.

Technical Background

An image having uniform glossiness such as silver halide photographic image is difficultly obtained by electrophotographic method since the image is formed by granule toner particles, consequently, the image surface becomes irregular and uniform glossiness cannot be formed.

Therefore, a method for forming the uniform glossiness similar to the silver halide photograph has been investigated.

For forming a glossy image, there is a means by improving the fixing process for thermally fixing the toner image. However, the problem of difference in the glossiness between the portion of the toner image and the portion where no or small amount of toner exists cannot be completely solved by such the method.

A problem that the portion of the toner image is protruded as relief is not solved also.

Tokkai Hei 7-56409 proposes a method in which a mirror image of the original image is transferred and fixed on a transparent film and a light reflecting material is laminated on the toner image carrying surface of the transparent film.

In the image formed by such the method, the surface of the transparent film opposite to the toner image carrying surface becomes as the outermost surface of the finished image and the toner image is sandwiched by the transparent film and the light reflecting material. Therefore, an image having high and uniform glossiness can be obtained since the surface of the image is mirror surface with no toner image.

However, the following problem remains in the above method which is basically superior for obtaining a photograph with high glossiness.

In the fixing process of toner image, the fixation is performed while coating a releasing agent (for example offset preventing oil) onto the heating member since offset phenomenon is caused by that a part of the toner constituting the image adheres to the heating member. However, the releasing agent tends to hinder the adhesion between the transparent film and the light reflecting material since the releasing agent is principally composed of oil. When such the releasing agent is employed, the oil adheres on the entire surface of the transparent film so that the light reflecting material laminated on the transparent substrate tends to be easily peeled and problems of peeling off and slipping are caused.

SUMMARY OF THE INVENTION

An object of the invention is to solve the above-described problems and to provide an image forming method and an image forming apparatus by which an image having uniform glossiness is formed and the transparent substrate and the light reflecting material are difficultly peeled off so that a durable print of photograph can be obtained.

The above objects can be the following constitutions.

1. An image forming method comprising the steps of a) forming a mirror image by a toner on a transparent substrate, and b) laminating a light reflecting material onto the toner carrying surface of the transparent substrate by putting an adhering layer or a tacking layer between the light reflecting material and the transparent substrate.

2. An image forming apparatus for forming a toner image by electrophotographic process comprising an image forming section for forming a mirror image by a toner containing a wax on a transparent substrate, a fixing means for fixing the toner image to the transparent substrate, and a laminating section for laminating a light reflecting material onto the toner carrying surface of the transparent substrate.

BRIEF DESCRIPTION OF THE DRAWINGS

FIG. 8 shows a color image forming apparatus as the second example of the embodiment of the invention.

DETAILED DESCRIPTION OF THE PREFERRED EMBODIMENT

Figure 1:
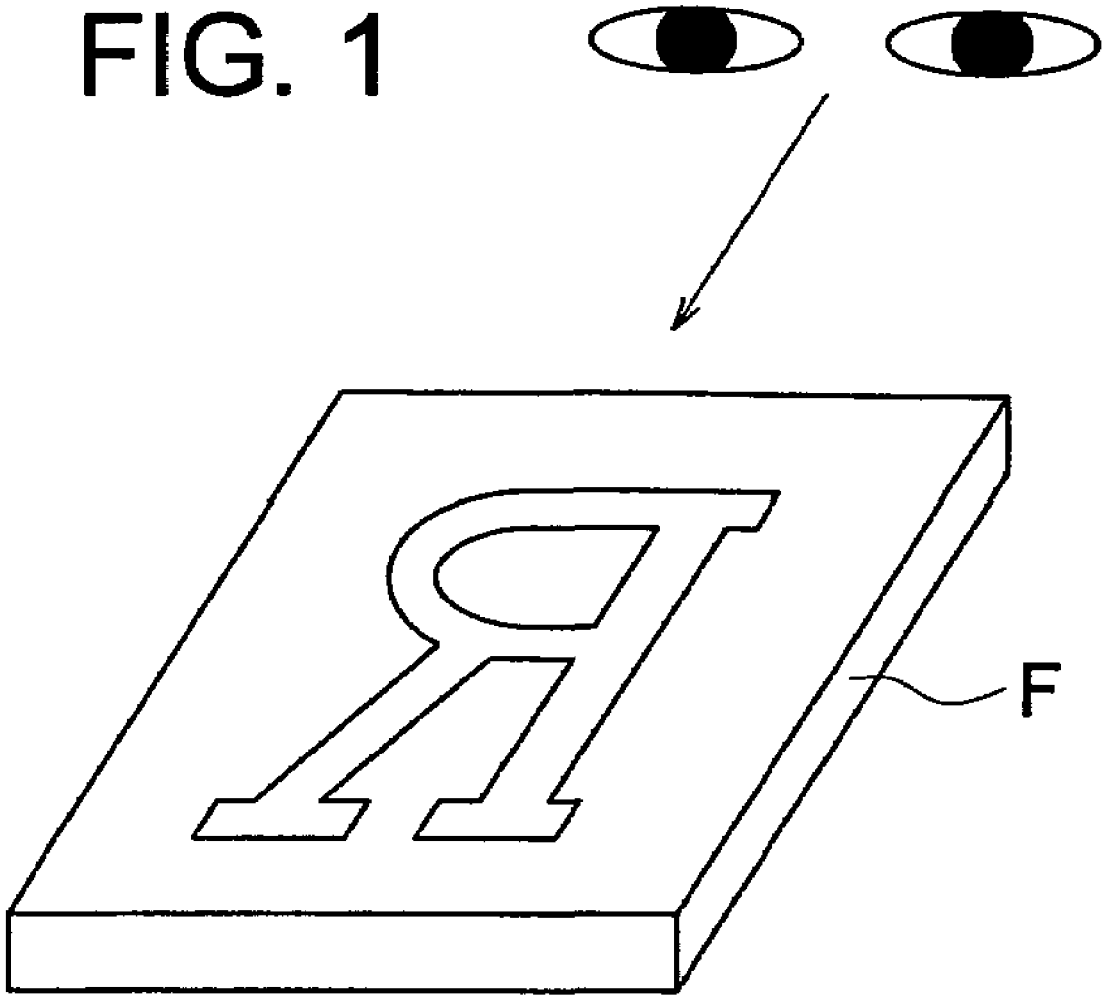
FIG. 1 shows a mirror image formed on the transparent substrate.

The invention is described bellow referring embodiments thereof, but the invention is not limited to the embodiments.

An embodiment of the image forming method of the invention includes the following image forming process, fixing process and laminating process.

(1) Image Forming Process

The image forming process is a process for forming a mirror toner image on the transparent substrate; particularly the toner image is formed by electrophotographic method.

Namely, an electrostatic latent image is formed on a photoreceptor by charging and light exposing the photoreceptor, and developing the electrostatic latent image.

The toner image on the photoreceptor is transferred onto a transparent substrate.

The transfer of the toner image from the photoreceptor to the transparent substrate is carried out by a direct transfer or an indirect transfer through an intermediate transfer member.

The toner image formed on the transparent substrate is a mirror image of an original image reversed in vertical or horizontal direction.

The photoreceptor is imagewise exposed by a light source such as a laser or a LED according to the image data in the course of the image formation; the imagewise exposure is carried out by image processing corresponding to the number of times of transfer in the course of the direct transfer or the indirect transfer so as to form the mirror image.

(2) Fixing Process

The fixing process for fixing the toner image to the transparent substrate is carried out by inserting the transparent substrate carrying the unfixed toner image into a nipping portion formed by a heating member and a pressing member and conveying by nipping.

A roller fixing device having a heating roller as the heating member and a pressing roller as the pressing member in which the recording medium is nipped and conveyed by the pair of the rollers, and a belt fixing device having a belt or a roller as the heating member and a belt or a roller in which the recording medium is nipped and conveyed by them, are preferably employed as the fixing means.

Hitherto, the fixation of a multi-color toner image has been performed while coating offset preventing oil such as silicone oil. However, the offset preventing oil reduces the adhering force between the transparent substrate and the reflection material so that the durability of the obtained photograph is degraded and the transparent substrate is easily peeled off from the reflection material.

In the invention, the fixation is carried out without the use of the offset preventing oil for solving the above problems, and the later-mentioned toner of the invention, namely, a toner prepared by a wet method in which wax is substantially not exposed to the surface of the toner particle is employed.

The content of the wax can be made higher in such the toner, and the offset and winding of the recording medium can be easily prevented since the wax is molten and oozed out to the particle surface at the portion for contacting the toner with the heating member even though the oil is not coated on the heating member in the fixing process. As a result of that, the bonding force between the transparent substrate and the light reflecting material laminated with the substrate is strengthen so that the problems of peeling and slipping can be solved.

Moreover, in the toner of the invention, the wax is difficultly oozed out between the transparent substrate and the toner image as described later since the wax is substantially not exposed to the surface of the toner particle as shown in FIGS. 2*a* and 2*b*. As a result of that, a merit can be obtained that the transparent substrate is difficultly peeled from the light reflecting material.

Contrary, when the toner image is developed by a crushed toner as shown in FIG. 2*c*, the wax content in the crushed toner itself is difficultly increased and the oil for preventing offset is difficultly eliminated. Therefore, the bonding force between the transparent substrate and the light reflecting material laminated with the substrate is reduced and the problems of peeling and slipping tend to be caused.

Furthermore, the wax is transferred from the toner to the heating member and easily retransferred from the heating member to the transparent substrate since the major portion of the toner particle surface is covered by the wax. As a result of that, the bonding force between the transparent substrate and the light reflecting material laminated with the substrate is reduced and the problems of peeling and slipping tend to be caused as described later in detail.

Figure 3:
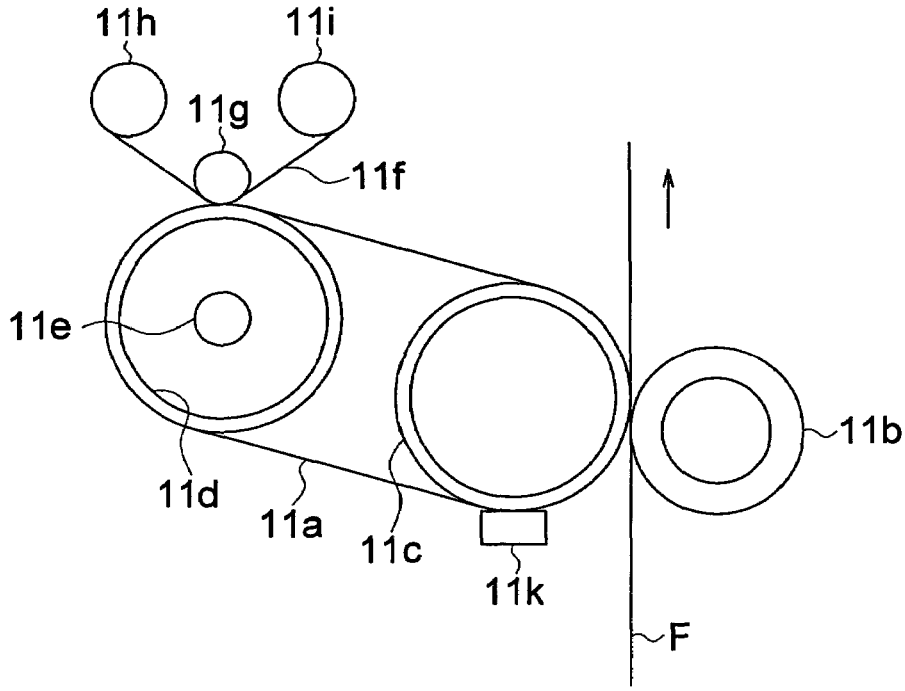
FIG. 3 shows an example of the fixing means.

FIG. 3 shows a preferable example of the fixing means.

In FIG. 3, a fixing belt 11*a* is laid with strain by supporting rollers 11*c* and 11*d* and contacted by pressing to a pressing roller 11*b*. A heater 11*e* is provided in the supporting roller 11*d*, and the heater 11*e* heats the supporting roller 11*d* and the fixing belt 11*a* so as to raise the temperature of the fixing belt by a fixing temperature.

The surface temperature of the fixing belt 11*a* is detected by a thermal sensor 11*k* and the temperature of the fixing belt 11*a* is controlled according to the detected temperature so as to hold the temperature at a constant level.

A transparent substrate F carrying a unfixed toner image is nipped and conveyed by the fixing belt by 11*a* and the pressing roller 11*b* in the direction of the arrow sign and heated at the time of passing the nipping potion between the fixing belt 11*a* and 11*b* so as to fixing the toner image to the transparent substrate F.

Members 11*f* through 11*j* is a cleaning means for cleaning the fixing belt 11*a*, in which a cleaning web 11*f* laid by stretching between a bulk roll 11*h* and a taking out roller 11*i* is contacted to the fixing belt 11*a* by a pressing roller 11*g* and cleans the fixing belt 11*a* for removing the wax adhering on the fixing belt 11*a*. The cleaning web 11*f* is renewed for every designated working time of the fixing means.

The adhering amount of the wax contained in the toner to the fixing belt 11*a* is insufficient for reducing the adhering force between the transparent substrate and the light reflecting material in the similar degree to that caused by the offset preventing oil coated to the heating member, and a print in which the transparent film F and the paper P are more strongly bonded is formed by cleaning by the cleaning web 11*f*.

(3) Laminating Process

In the laminating process, the transparent substrate carrying is laminated with the light reflecting material and the toner image carrying surface of the transparent substrate is contacted to the light reflecting material. The toner image is sandwiched by the transparent substrate and the light reflecting material, therefore the mirror image appears as a right image since the image is observed from the side of the transparent substrate carrying no toner image.

Figure 4:
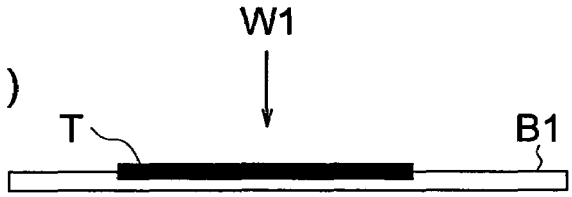
FIG. 4 shows the laminating process.
Figure 4:
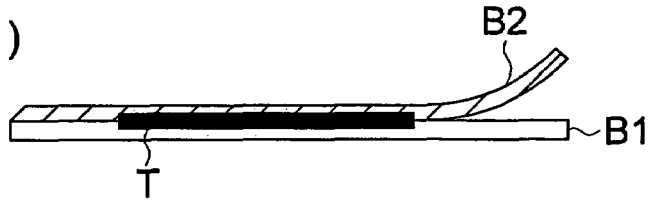
Figure 4:
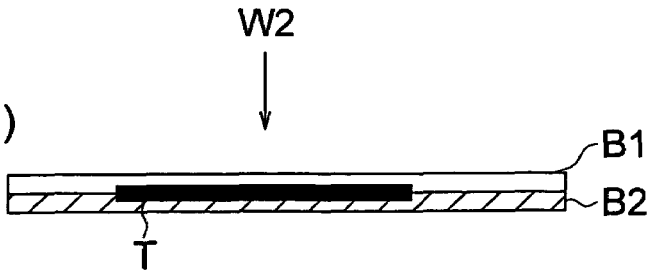

FIG. 4 shows an example of the laminating process.

As is shown in FIG. 4, a toner image T is formed on a transparent substrate B1. The toner image viewed from the side of the arrow W1 is a mirror image reversed in the vertical or horizontal direction.

After that, a light reflecting material B2 is laminated by adhering or tacking onto the toner image carrying surface of the transparent substrate B1 as shown in FIG. 4*b*.

The photograph completed by the laminating is viewed in the direction of the arrow sign W2. As a result of that, a right image is observed.

The lamination is performed by adhering or tacking. The adhering layer or a tacking layer is on the light reflecting material which is previously provided or formed by coating in the course of laminating process.

Known adhering agents, for example, a hot-melt adhering agent principally composed of an ethylene-vinyl acetate copolymer, an ethylene-ethyl acrylate copolymer or a modified polyolefin, and a thermal hardening type adhering agent such as an epoxy type, can be employable as the adhering agent.

Known tacking agents such as a solvent type acryl tacking agent and an emulsion type tacking agent are usable.

(4) Transparent substrate and light reflecting material

A PET (polyethylene terephthalate) film is preferable and the thickness thereof is preferably from 50 to 500 μm.

A thickness of smaller than 50 μm causes appearance of irregularity caused by the toner image on the surface of the print of photograph in some cases. When the thickness exceeds 500 μm, the treatment in a usual electrophotographic image forming apparatus is hindered in some cases.

The light reflecting material is a white, milk-white or silver reflective sheet, and coated paper for printing, a synthesized paper such as one having commercial name of Yupo, resin-coated paper and resin film are preferable.

When the coating layer of the coated paper contains a polyolefin such as paraffin, polyethylene and polypropylene, such the component dissolves with the wax and functions as an adhesive. Therefore, the transparent substrate and the light reflecting material can be more strongly bonded by heating adhesion by the use of the coated paper containing a substance capable of dissolving with the wax for acting the coated layer as the adhering layer or the tacking layer.

(5) Developer and Wax-Containing Toner

The development is performed by the use of a double-component developer. For a magnetic carrier particle of carrier constituting the double-component developer, known materials such as a metal such as iron, ferrite and magnetite, an alloy of the metal and another metal such as aluminum or lead can be employed. Particularly, ferrite is preferable. The volume average diameter of the magnetic particles is preferably from 15 to 100 μm, and more preferably from 25 to 80 μm.

The volume average diameter of the carrier particles can be typically measured by a laser diffraction particle size distribution measuring apparatus having a wet type dispersing machine HELOS, manufactured by Sympatec Co., Ltd.

A carrier comprising a magnetic particle coated by a resin or a magnetic particle dispersed in a resin so called as a resin dispersion type carrier is preferably employed as the carrier. Though the resin for coating the magnetic particle is not specifically limited for example, an olefin resin, a styrene type resin, a styrene-acryl type resin an ester type resin and a fluororesin are employable. As the resin for constituting the resin dispersion type carrier, know resins can be employed without any limitation, for example, a styrene-acryl type resin, a polyester resin, a fluororesin and a phenol resin are employable.

A toner containing a wax is employed as the toner. As the wax-containing toner, one from which the wax is difficultly oozed to the surface thereof is employed.

By the use of such the toner, the adhesion or tack between the transparent substrate and the light reflecting material is made uniform and strong, and a durable printed image can be formed in which the peel off or the slip of the transparent substrate and the light reflecting material is little.

One of such the toner is a toner produced by a wet process.

The toner produced by the wet process is a toner produced by a process in which the toner particles are formed in a liquid such as an aqueous medium, for example, a toner produced by an emulsion polymerization method, a suspension polymerization method, an emulsifying dispersion method, a dispersion polymerization method or a seed polymerization method.

The polymerized toner is preferable, in which the toner particle is prepared by polymerization or fusion of plural particles formed by polymerization. Particularly, the toner produced by the suspension polymerization method or emulsion polymerization method is preferable and the toner produced by the emulsion polymerization method is most preferable.

<Suspension Polymerization Method>

An example of the suspension polymerization method is as follows.

In a polymerizable monomer, a charge controlling resin is dissolved and various constituting materials such as a colorant, a wax and an additive such as a polymerization initiator are added, and then the constituting materials are dissolved or dispersed in the polymerizable monomer by a homogenizer, a sand mill, a sand grinder or an ultrasonic disperser. The polymerizable monomer in which the constituting materials are dissolved or dispersed is dispersed in an aqueous medium containing a dispersion stabilizer using a homomixer or a homogenizer so that the polymerizable monomer is made to a state of oil droplet having a desired size for the toner. After that, the dispersion is poured into a reaction vessel (stirring vessel) having a stirring wings as later-mentioned, and heated for progressing the polymerization reaction. After completion of the reaction, the dispersion stabilizer is removed and the particles are filtered, washed and dried to prepare the toner.

<Emulsion Polymerization Method>

As the emulsion polymerization method, those disclosed in Tokkai Hei 5-256252 and 9-96919 can be applied. Namely, a method in which an emulsion of a polymerizable monomer with necessary additives is prepared and polymerized to form resin particles, and the resin particles are salted out, coagulated and fused with dispersed particles of the constituting materials such as the colorant, and these particles are dispersed by using a emulsifying agent and salted out by adding a coagulating agent in an amount of not less than the critical coagulation concentration and fused particles are simultaneously formed and gradually grown by heating at a temperature not less that the glass transition point of the formed polymer for fusion of the coagulated particles. The growing of the particles is stopped by adding a lot of water at the time when the diameter of the particles is attained at the objective size, and then further heated and stirred for controlling the shape of the particle by smoothing the particle surface. And then the particles are dried by heating in a fluid state containing moisture. Thus a toner suitable for the invention can be obtained. In the prepared toner particles, wax can be uniformly dispersed and the offset preventing effect at the fixing time can be raised compared with the toner particles prepared by the suspension polymerization. The cross section of the toner particle prepared by the emulsion polymerization is shown in FIG. 2*a* and that prepared by the suspension polymerization is shown in FIG. 2*b*. A solvent capable of freely mixing with water such as alcohol may be simultaneously added with the coagulating agent.

In the toner formed by the above-described polymerization method, the amount of the wax can be made larger than that in a usual toner prepared by crushing method. Therefore, the offset onto the heating roller in the fixing process can be prevented by the wax without the coating of the oil.

The toner produced by the wet process differs as follows from the toner produced by the crushing method.

Figure 2:
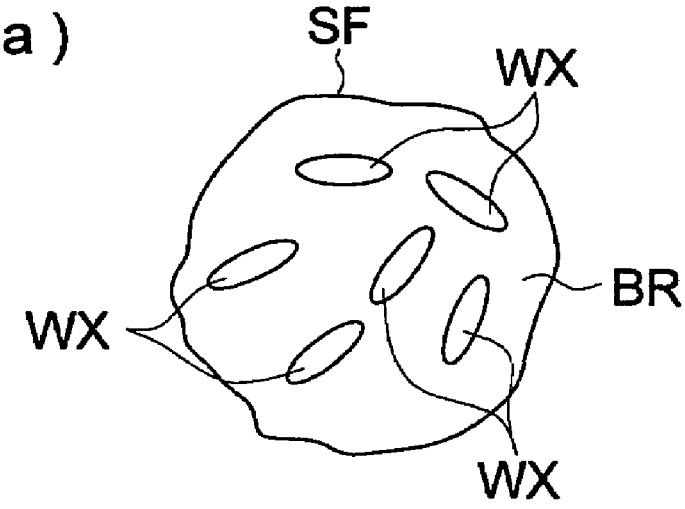
FIG. 2 shows the cross section of a toner particle.
Figure 2:
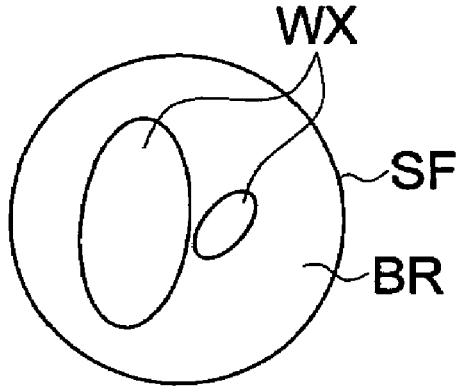
Figure 2:
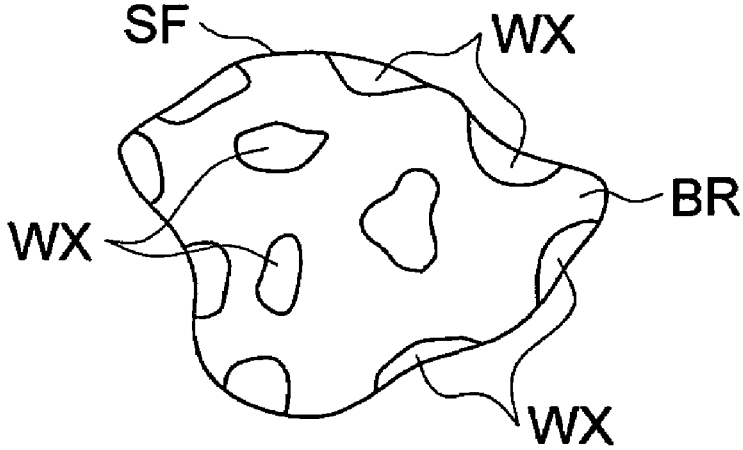

The cross section of the toner produced by the wet process is displayed in FIG. 2 comparing with that of the toner produced by the crushing method.

As examples of the toner produced by the wet process, the cross section of the toner particle produced by the emulsion polymerization method is shown in FIG. 2*a* and that of the toner particle produced by the suspension polymerization method is shown in FIG. 2*b*, and the cross section of an example of the toner particle produced by the crushing method is shown in FIG. 2*c*.

In the toner particle produced by the emulsion polymerization method or that produced by the suspension polymerization method, the surface SF thereof is almost covered by the binder resin BR, and the wax is substantially not exposed on the surface SF.

In contrast, in the toner produced by the crushing method, the wax WX is exposed on the particle surface SF and the almost surface of the particle is covered by the wax WX as shown in FIG. 2*c*. The shape of particle shown in FIG. 2*c* is inevitably formed by the crushing method, because the particle is crushed at the presence portion of the wax as the cleavage plane. Therefore, the major part of the surface is occupied by the wax.

In the fixing process, the toner image on the sheet or the transparent substrate is heated (the heat is applied from the heating roller side of the heating roller and the pressing roller). Therefore, the conduction situation of heat is different on the heating roller side and on the sheet side.

Namely, in a short duration of passing the toner image through the nipping portion between the heating roller and the pressing roller, a temperature difference is caused between the heating roller side and the pressing roller side of the toner. In the case of the toner produced by the wet process, the wax is oozed out to the toner particle surface on the heating roller side but the oozing out of the wax is small on the pressing roller side according to the difference in the temperature. As a result of that, unnecessary oozing out of the wax is not caused even though the offset is prevented.

In the case of the crushed toner, the wax at the particle surface is molten and adhers to the heating roller and the sheet. Accordingly, the transparent substrate and the light reflecting material tend to be peeled off from each other and tend to be slipped when the laminated print is bended.

Such the tendency is particularly strengthen in a color image such as a photograph since the image is formed on the over all sheet surface. The toner in which the wax is substantially not exposed on the toner particle surface as shown in FIGS. 2*a* and 2*b* can be produced.

By the use of such the toner, the transparent substrate and the light reflecting material can be strongly bonded by adhesion or tack when the print is prepared in which the toner image is formed on the laminated surface of the transparent substrate and the light reflecting material.

The toner particle in which the wax is substantially not exposed on the surface thereof is the particle in which not less than 90% of the particle surface is occupied by the component other than the wax such as the binder.

The exposing degree of the wax on the toner particle surface is measured by the following method.

The structure of the toner particle can be sufficiently observed by a transmission electron microscope known in the field of the art such as LEM-2000, manufactured by Topcon Co., Ltd. In the invention, the exposing degree of the wax is calculated from a projection image of transmission electron microphotograph with a magnitude of 10,000.

The photograph taking by the transmission electron microscope is carried out by a usually known method for measuring toner particles. In concrete, the cross section of the toner particle is measured by the following method; the toner particles are dispersed in a usual thermal hardenable epoxy resin and hardened for embedding, or the toner particles are dispersed in a styrene fine powder having a particle diameter of about 100 nm and molded by pressing, and then thus obtained block is dyed by $Os_4O_3$ or $Ru_4O_3$ according to necessity and sliced by a microtome having a diamond edge to prepare a thin piece shaped sample, and the cross section of the toner particle in the sample is photographed by the transmission electron microscope. In the photograph, the outlines of the toner particle and that of the wax can be distinguished.

Therefore, the wax exposed portion is detected where the outline of the toner particle and that of the wax is overlapped, and the ratios of the length of the outline of the exposed wax to the length of the out line of the toner particles on the photograph is calculated and averaged.

"Not less than 90% of the particle surface is occupied by a component other than the wax" means that the averaged ratio is less than 10%, the average value of the ratio is calculated with respect to 10 particles in the photographed sample.

[Description of the Process]

As a suitable polymerization method for forming a resin particle containing the wax or a covering layer, an emulsion polymerization method is applicable, in which a monomer solution composed of a monomer and the wax dissolved in the monomer is dispersed as oil droplets by applying mechanical energy in an aqueous medium containing a surfactant in a concentration of not more than the critical micelle forming concentration, and a polymerization initiator is added to the resultant dispersion so that the monomer is polymerized in the droplet by radical polymerization. The toner produced such the polymerization is preferable since the effects of the invention is enhanced by the use of the toner. In the above method, an oil-soluble polymerization initiator may be applied in place of or together with the water-soluble polymerization initiator.

The wax-containing toner described below is prepared by the following procedure: Composite resin particles are formed in the presence of no colorant and a dispersion of colorant is added to the resultant composite rein particle dispersion, and then the composite resin particles and the colorant particles are salted out and fused. The polymerization reaction for obtaining the composite resin particles is not impeded by preparing the composite resin particles in the system containing no colorant. Therefore, the anti-offset ability of the toner is not degraded and contamination of the fixing means or the image caused by the accumulation of the toner is not caused when such the toner is employed.

Any monomer or oligomer does not remain in the toner particle since the polymerization reaction for obtaining the composite resin particle is completely performed; therefore, bad odor is not caused in the thermal fixing process of the image forming method using such the toner.

The production method of the toner by the emulsion polymerization is described for each of the processes.

<Polymerization Process>

In the production process of the wax-containing toner, it is one of the traits that the polymerizable monomer is polymerized in an aqueous medium. Namely, the resin particle (core particle) or the covering layer (intermediate layer) containing the was is obtained in a form of latex particle by dissolved the wax in the monomer and dispersing the resultant monomer solution as oil droplets in the aqueous medium, and by subjecting the dispersion to polymerization treatment by adding the polymerization initiator.

The aqueous medium is a medium comprising from 50 to 100% by weight of water and 0 to 50% by weight of a water-permissible organic solvent. As the water-permissible organic solvent, methanol, ethanol, isopropanol, butanol, acetone, methyl ethyl ketone and tetrahydrofuran are exemplified, and the alcohol type organic solvent which cannot dissolve the resultant resin is preferable.

By a mini-emulsion method in which the oil droplets are formed by mechanical means, the wax dissolved in the oil phase is difficultly released and sufficient amount of the wax can be contained in the obtained resin particle or the covering layer, such the situation is different from the usual emulsion polymerization method.

The diameter of the dispersed particle is from 10 to 1,000 nm, preferably from 50 to 1,000 nm, and more preferably from 30 to 300 nm. The phase separation structure is controlled so as to be uniform and the nearest wall distance is controlled so as to have no peak at a specific value by giving distribution to the dispersed particle diameter.

The diameter of the composite resin particle obtained by the polymerization process is preferably within the range of from 10 to 1,000 nm in weight average diameter measured by an electrophoretic light scatter photometer ELS-800, manufactured by Ootsuka Denshi Co., Ltd.

The glass transition point (Tg) of the composite resin particle is preferably within the range of from 48 to 74°, more preferably from 52 to 64° C.

The softening point of the composite resin particle is preferably within the range of from 95 to 140° C.

<Slat Out/Fusion Process>

The salting out/fusion process is a process for obtaining irregular shaped (non-spherical) toner particle by salting out/fusing (simultaneous occurrence of salting out and fusion) the composite resin particles obtained by the above polymerization process together with the colorant particles.

The "salting out/fusion" means simultaneous occurrence of the salting out (coagulation of the particles) and the fusion (disappearance of the interface between the particles) or to make simultaneously progress salting out and fusion. It is necessary for simultaneously occurring the salting out and the fusion that the particles (the composite resin particles and the colorant particles) are coagulated at a temperature not higher than the glass transition point (Tg) of the resin constituting the composite particle.

In the salting out/fusion process, internal additive particle having a number average primary particle diameter of about 10 to 1,000 nm such as a charge controlling agent may be salted out/fused together with the composite resin particles and the colorant particles. The colorant particle may be subjected to a surface modified treatment in which a known surface modifying agent can be employed.

<Ripening Process>

The ripening process is a process following the salting out/fusion process, and is a process for phase separating the wax by maintaining the rein particle after the fusion at a temperature near the melting point, preferably the melting point ±20° C., and stirring with a constant strength. The dispersing state of the wax in the toner particle can be also controlled in this process.

<Filtration-Washing Process>

In the filtration-washing process, a filtration treatment for filtering out the toner particles from the dispersion system of the toner particle obtained in the above process and a washing treatment for removing the adhering materials such as the surfactant and the salting out agent from the filtered toner particles (a cake-like lump) are performed. For the filtration, methods such as a centrifugal method, a vacuum filtration using a Nutsche funnel and a filtration by a filter press are applicable without any limitation.

<Drying Process>

This process is a process for drying the washed toner particles.

In this process a spray dryer, a vacuum freezing drying machine and a vacuum dryer are applicable, and a fixed rack drying machine, a moving rack drying machine, a fluid bed drying machine, a rotary drying machine, and a stirring drying machine are preferably applicable.

The moisture in the dried toner particles is preferably not more than 5%, and more preferably not more than 2%.

The toner particles have uniform properties and a sharp charge distribution; therefore, images excellent in the sharpness can be formed for a long period. By such the toner particle uniform in the composition, molecular weight and the surface properties, the ant-offset ability and the winding prevention ability can be improved while holding good adhesiveness (high fixing strength) to the image supporting material and an image having suitable glossiness can be obtained.

[Components Constituting the Toner]

Various constituting components employed in the toner producing processes are described in detail below.

<Polymerizable Monomer>

For the polymerizable monomer to be employed in the process for forming the resin or binder, a hydrophobic monomer is essential and a crosslinkable monomer is employed according to necessity. At least a monomer having an acidic polar group in the structure thereof as follows is desirably contained.

(1) Hydrophobic Monomer

A known monomer can be employed without specific limitation for the hydrophobic monomer constituting the monomer composition. One or more kinds of the monomer can be employed for satisfying required properties.

In concrete, a mono-vinyl aromatic type monomer, a (meth)acrylate type monomer, a vinyl ester type monomer, a vinyl ether type monomer, a mono-olefin type monomer, di-olefin type monomer and a halogeno-olefin type monomer can be employed.

Examples of the vinyl aromatic type monomer include a styrene type monomer such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene and a derivative of them.

Examples of the (meth)acrylate type monomer include acrylic acid, methacrylic acid, methyl acrylate, ethyl acrylate, butyl acrylate, 2-hexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

Examples of the vinyl ester type monomer include vinyl acetate, vinyl propionate and vinyl benzoate and those of vinyl ether type monomer include vinyl methyl ether, vinyl ethyl ether, vinyl isobutyl ether and vinyl phenyl ether.

Examples of the mono-olefin type monomer include ethylene, propylene, isobutylene, 1-butene, 1-pentene and 4-methyl-1-pentene, and those of the di-olefin monomer include butadiene, isoprene and chloroprene.

(2) Crosslinkable Monomer

The crosslinkable monomer may be added for improving the properties of the resin particle. As the crosslinkable monomer, a compound having two unsaturated bonds such as divinylbenzene, divinylnaphthalene, divinyl ether, diethylene glycol methacrylate, ethylene glycol dimethacrylate, polyethylene glycol dimethacrylate and diallyl phthalate are applicable.

(3) Monomer having an Acidic Polar Group

As the monomer having an acidic polar group, (a) an α,β-ethylenic unsaturated compound having a carboxyl (—COOH) group and (b) an α,β-ethylenic unsaturated compound having a sulfonic acid (—$SO_3H$) group can be cited.

Examples of the α,β-ethylenic unsaturated compound having a carboxyl group of (a) include acrylic acid, methacrylic acid, fumaric acid, maleic acid, itaconic acid, cinnamic acid, mono-butyl maleate, mono-octyl maleate, and their salts of a metal such as Na and Zn.

Examples of the α,β-ethylenic unsaturated compound having a sulfonic acid group of (b) include sulfonated styrene and sodium salt thereof, allylsulfosuccinic acid, octyl allylsulfosuccinate and their sodium salts.

<Polymerization Initiator>

A water-soluble radical polymerization initiator can be optionally employed. For example, a persulfate such as potassium persulfate and ammonium persulfate, an azo type compound such as 4,4-azo-bis-4-cyanovalerianic acid and its salt and 2,2'-azo-bis(2-amidinopropane) salt, and a peroxide compound can be employed. The above radical polymerization initiator can be made a redox type initiator by combining with a reducing agent according to necessity. By the use of the redox type initiator, advantages can be obtained such as that the polymerization activity can be raised and the polymerization temperature can be lowered, and the polymerization time can be shortened.

The polymerization temperature is, for example, from 50° C. to 90° C., although the temperature is not specifically limited as long as it is not lower that the lowest radical generation temperature of the polymerization initiator. The polymerization can be performed at a room temperature or less by the use of an ordinary temperature polymerization initiator prepared by a combination of hydrogen peroxide and a reducing agent such as ascorbic acid.

<Chain-Transfer Agent>

A known chain-transfer agent can be employed for controlling the molecular weight of the polymer. Though the chain-transfer agent is not specifically limited, a compound having a mercapto group such as octylmercaptane, dodecylmercaptane and tert-dodecylmercaptane is employed. The compound having a mercapto group is preferably employed because a toner having sharp distribution of molecular weight distribution and excellent in the storage ability, fixing strength and anti-offset property can be obtained. Preferable examples of the mercapto group-having compound include ethyl thioglycolate, propyl thioglycolate, butyl thioglycolate, t-butyl thioglycolate, 2-ethylhexyl thioglycolate, octyl thioglycolate, decyl thioglycolate, dodecyl thioglycolate, an ethylene glycol derivative having a mercapto group, a neopentyl glycol derivative having a mercapto group and a pentaerythrytol derivative having a mercapto group. Among them, n-octyl-3-mercaptopropionate is particularly preferred which inhibits bad order on the occasion of the thermal fixing of the toner.

<Surfactant>

When the mini-emulsion polymerization of the polymerizable monomer is performed, the monomer is preferably dispersed into the oil droplets in the aqueous medium by the use of a surfactant. Though the surfactant to be used on such the occasion is not specifically limited, the following ionic surfactants can be exemplified as the suitable compound.

Examples of the ionic surfactant include a sulfonic acid salt such as sodium dodecylbenzene sulfonate, sodium arylalkylpolyethersulfonate, sodium 3.3-disulfondiphenylurea-4,4-diazo-bis-amino-8-naphthol-6-sulfonate, sodium orthocarboxybenzene-azo-dimethylaniline and sodium 2,2,5,5-tetramethyl-triphenylmethane-4,4-diazo-bis-β-naphthol-6-sulfonate, a sufuric acid ester salt such as sodium dodecylsulfate, sodium tetradecylsulfate, and sodium pentadecylsulfate and sodium octylsulfate, a fatty acid salt such as sodium oleate, sodium laurylate, sodium caprate, sodium caprylate, sodium capronate, potassium stearate and calcium oleate.

Surfactants represented by the following Formulas 1 and 2 are preferably employed.

$$R_1(OR_2)_nOSO_3M \qquad \text{Formula 1}$$

$$R_1(OR_2)_nSO_3M \qquad \text{Formula 2}$$

In Formulas 1 and 2, $R_1$ is an alkyl group or an arylalkyl group each having 6 to 22 carbon atoms, preferably an alkyl group or an arylalkyl group each having 8 to 20 carbon atoms, and more preferably an alkyl group or an arylalkyl group each having 9 to 16 carbon atoms.

Examples of the alkyl group having 6 to 22 carbon atoms represented by $R_1$ include an n-hexyl group, an n-heptyl group, an n-octyl group, an n-decyl group, an n-undecyl group, an n-hexadecyl group, a cyclopropyl group, a cyclopentyl group and a cyclohexyl group, and those of the arylalkyl group represented by $R_1$ include a benzyl group, a diphenylmethyl group, cinnamyl group, a styryl group, a trityl group and a phenetyl group.

In Formulas 1 and 2, $R_2$ is an alkylene group having 2 to 6 carbon atoms, and preferably that having 2 or 3 carbon atoms. Examples of the alkylene group having 2 to 6 carbon atoms represented by $R_2$ include an ethylene group, a trimethylene group, a tetramethylene group, a propylene group and an ethylethylene group.

In Formulas 1 and 2, n is an integer of from 1 to 11, preferably from 2 to 10, more preferably from 2 to 5, and particularly preferably 2 or 3.

In Formulas 1 and 2, a mono-valent metal represented M is, for example, sodium, potassium and lithium. Among them, sodium is preferably employed.

Concrete examples of the surfactant represented by Formula 1 or 2 are listed below. However, the invention is not limited to them.

$C_{10}H_{21}(OCH_2CH_2)_2OSO_3Na$ Compound 101

$C_{10}H_{21}(OCH_2CH_2)_3OSO_3Na$ Compound 102

$C_{10}H_{21}(OCH_2CH_2)_2SO_3Na$ Compound 103

$C_{10}H_{21}(OCH_2CH_2)_3SO_3Na$ Compound 104

$C_8H_{17}(OCH_2CH(CH_3))_2OSO_3Na$ Compound 105

$C_{18}H_{37}(OCH_2CH_2)_2OSO_3Na$ Compound 106

<Coagulating Agent>

A metal salt can be employed in the process for slating out, coagulating and fusing the resin particles from the dispersion of the resin particles prepared in the aqueous medium; and a salt of bi-valent or tri-valent metal is more preferably employed, because the critical coagulation concentration (coagulation value or coagulation point) of the di-valent or tri-valent metal salt is lower than that of the mono-valent metal salt.

Examples of the coagulating agent usable in the above process include a salt of mono-valent or alkali metal such as sodium, potassium and lithium, a salt of di-valent metal, for example, an alkali-earth metal such as calcium and magnesium, manganese and copper, and a salt of a tri-valent metal such as iron and aluminum.

Concrete examples of the metal salt are as follows. A mono-valent metal salt such as sodium chloride, potassium chloride and lithium chloride, a di-valent metal salt such as calcium chloride, zinc chloride, copper sulfate, magnesium sulfate and manganese sulfate, and a trivalent metal salt such as aluminum chloride and iron chloride are employable. The salt is optionally selected from these salts and the di-valent and trivalent metal salts having low critical coagulation concentration are preferable.

The critical coagulation concentration is an indicator relating to the stability of the dispersoid in the aqueous dispersion system, and is the concentration of the coagulating agent causing coagulation when the coagulating agent is added to the dispersion system. The coagulation concentration is widely varied depending on the latex itself and the coagulating agent. The critical coagulation concentration can be known by the description in, for example, S. Okamura et al. "Koubunshi Kagaky (Polymer Chemistry)", 17, 601, 1960. On another way, it is possible that the ζ-potential of the dispersion is measured while adding a desired salt to the dispersion so as to vary the concentration thereof in the suspension and the coagulation concentration is determined by the point where the variation of ζ-potential is begun.

In the above process, the polymer fine particle dispersion is treated by the metal salt so that the concentration of the metal salt is exceeded the critical coagulation concentration. On this occasion, it is naturally selected according to the object that the metal salt is added in a solid state or in an aqueous solution state. The salt is added in the aqueous solution state, it is necessary that the concentration of the added salt exceeds the critical coagulation of the polymer particles in the total volume of the polymer particle dispersion and the metal salt solution.

In the invention, the concentration of the metal salt in the above process is preferably 1.2 times, and more preferably 1.5 times, of the critical coagulation concentration even though the concentration may be a value exceeding the critical coagulation concentration.

<Colorant>

The colorant necessary for obtaining the wax-containing toner is dispersed in an aqueous medium containing a surfactant.

The surfactant is dissolved in a concentration of not less than the critical micelle concentration (CMC) thereof in the aqueous medium in which the colorant is dispersed. The usable surfactants are the same as those usable in the foregoing polymerization process.

The weight average particle diameter (diameter of dispersed particle) of the colorant fine particles is from 30 to 500 nm, and preferably 50 to 300 nm. Outside the above range, the colorant is difficultly introduced into the toner particle because the floating of the colorant particle is made serious when the weight average diameter is less than 30 nm and the colorant particles cannot be suitably dispersed and are easily precipitated in the aqueous system when the weight average particle diameter is more than 500 nm. Under such the condition, the colorant particles are not included in the toner particle and undesirably remain in a free state in the aqueous medium. The weight average diameter of the colorant particles can be measured by an electrophoretic light scattering photometer ELS-800 manufactured by Ootsuka Denshi Co., Ltd.

The colorant is put into the aqueous medium containing the surfactant and then preliminarily dispersed (roughly dispersed) by a propeller stirrer to prepare a preliminary dispersion in which coagulated particles of the colorant are dispersed. The preliminary dispersion is supplied into a stirring apparatus having a screen for dividing a stirring room and a rotor rotating with high speed in the stirring room and dispersed by the apparatus for preparing a dispersion of the colorant fine particles in a suitable dispersed state.

Cleamix, manufactured by M-Tech Co., Ltd., can be used as the stirring apparatus for dispersing the colorant fine particles into the suitable dispersed stat. Cleamix has a rotor (stirring wings) rotating at high rate and a fixed screen rounding the rotor and giving sharing force, collision force, pressure variation, cavitation and a function of potential core to the liquid to be treated by such the structure so that the liquid to be treated is effectively emulsified and dispersed by the synergistic action of the above functions.

Though Cleamix is originally applied for forming an emulsion (a dispersion of liquid fine particles), it is found by the inventors that the colorant fine particle dispersion having a suitable average diameter and sharp particle diameter distribution can be obtained by applying Cleamix as an apparatus for dispersing the colorant fine particles in a solid state into the aqueous medium.

The colorant fine particles are subjected to the slat out/fusion treatment in the dispersed state in the aqueous medium. The aqueous medium in which the colorant fine particle is dispersed is preferably an aqueous solution containing the surfactant in a concentration of not less than the critical micelle concentration (CMC).

For salting out/fusing the composite resin particles with the colorant particles, it is necessary to add the salting out agent (coagulating agent) in an amount not less than the critical coagulation concentration to the dispersion in which the composite resin particles and the colorant particles are dispersed, and to heat the dispersion by a temperature not less than the glass transition point (Tg) of the composite resin particle.

The temperature range suitable for salting out/fusing is from (Tg+10° C.) to (Tg+50° C.), and particularly preferably from (Tg+15° C.) to (Tg+40° C.). An organic solvent capable of freely mixing with water ma be added for effectively performing the fusion.

After obtaining the colored particles, hereinafter referred to as toner particles, by salting out, coagulation and fusion of the resin particles and the colorant particles in the aqueous medium. And then the toner particles are separated from the aqueous medium. The separation is preferably performed at a temperature not less than the Kraft's point, and more preferably within the range of from the Kraft's point to Kraft's point+2° C., of the surfactant existing in the aqueous medium.

<Kraft's Point>

The Kraft's point is a temperature at which the aqueous solution containing the surfactant begins to be made turbid, and the Kraft's point is measured as follows.

A surfactant solution is prepared by adding practically using amount the coagulating agent to the aqueous medium to be employed in the salting out, coagulation and fusion process, and stood for 5 days at 1° C. After that the solution is gradually heated until becomes transparent while stirring. The temperature at which the solution is made transparent is defined as the Kraft's point.

Various kinds of inorganic pigment, organic pigment and dye can be employed as the colorant. Known inorganic pigments can be employed and concrete examples thereof are listed below.

As a black colorant, for example, a carbon black such as furnace black, channel black, acetylene black, thermal black and lamp black, and a magnetic powder such as magnetite and ferrite are employable.

These inorganic pigments can be employed singly or in a combination of selected plural kinds. The adding amount of the pigment is from 2 to 20%, and preferably from 3 to 15%, by weight of the polymer.

When the toner is a magnetic toner, the above magnetite can be added. In such the case, the magnetite is preferably added in an amount of from 20 to 60% by weight of the toner for giving designated magnetic properties.

Known organic pigments and dyes also can be employed. Concrete examples of them are listed below.

Examples of magenta or red pigments include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

Examples of orange or yellow pigments include C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156.

Examples of green or cyan pigment include C. I. Pigment Blue 15, C. I. Pigment Blue 15:2, C. I. Pigment Blue 15:3, C. I. Pigment Blue 16, C. I. Pigment Blue 60 and C. I. Pigment Green 7.

As the dyes, for example, C. I. Solvent Reds 1, 49, 52, 58, 63, 111 and 122, C. I. Solvent Yellows 19, 44, 77, 79, 81, 82, 93, 98, 103, 104, 112 and 162, C. I. Solvent Blues 25, 36, 60, 70, 93 and 95 are employable, a mixture of them is also employable.

These pigments and dyes can be employed solely or in combination of selected ones of them according to necessity. The adding amount of the pigment is from 2 to 20%, and preferably from 3 to 15%, by weight of the polymer.

The colorant constituting the toner may be modified on the surface thereof. Known surface modifying agent such as a silane coupling agent and a titanium coupling agent are preferably applied. Examples of the silane coupling agent include an alkoxysilane such as methyltrimethoxysilane, phenyltrimethoxysilane, methylphenyldimethoxysilane and diphenyldimethoxysilane, a siloxane such as hexamethyldisiloxane, and γ-chloropropyltrimethoxy silane, vinyltrichlorosilane, vinyltrimethoxysilane, vinyltriethoxysilane, γ-methacryloxytrimethoxysilane, γ-glycidoxypropyltrimethoxysilane, γ-mercaptopropyl-trimethoxysilane, γ-aminopropyltriethoxysilane and γ-ureidopropyltriethoxysilane. Examples of the titanium coupling agent include TTS, 9S, 38S, 41B, 46B, 55, 138S and 238S each put on the marked by Ajinomoto Co., Ltd., with commercial name of Plenact, and A-1, B-1, TOT, TST, TAA, TAT, TLA, TOG, TMSTA, A-10, TMT, B-2, B-4, B-7, B-10, TBSTA-400, TTS, TOA-30, TSDMA, TTAB and TTOP each put on the market by Nihon Soda Co., Ltd. Example of aluminum coupling agent is, for example, Plenact AL-M manufactured by Ajinomoto Co., Ltd.

The adding amount is preferably from 0.01 to 20%, and more preferably from 0.1 to 5%, by weight to the colorant. For modifying the colorant particle, a method is applicable, in which the surface modifying agent is added to the dispersion of the colorant particles and the system is heated for reacting. Thus surface modified colorant particles are obtained by filtrating and repeatedly washing by the solvent the same as that of the dispersion and drying.

<Metal Element>

From the viewpoint of inhibiting excessive charge on the toner particles and giving uniform charging ability, the electrostatic image developing toner of the invention is preferably contains the above-mentioned metal element in a state of metal or metal ion in an amount of from 250 to 20,000 ppm, more preferably from 800 to 5,000 ppm, of the toner for stabilizing and maintaining the charging property concerning to the environmental conditions.

The total amount of the di-valent or tri-valent metal element added as the coagulating agent and that of a mono-valent metal element added as the coagulation stopping agent is preferably from 350 to 35,000 ppm. The remaining amount of metal ion in the toner can be determined by measuring the intensity of fluorescent X-ray generated from the metal species employed as the coagulating agent such as calcium originated in calcium chloride by a fluorescent X-ray analyzing apparatus System 3270 manufactured by Rigaku Denki Kogyo Co., Ltd. In the concrete measuring method, plurality toners each containing a known amount different from each other of metal salt coagulating agent are prepared and 5 g of each of the toners is formed to a pellet and the relation (calibration curve) between the content of the metal salt coagulating agent in weight ppm and the intensity of the fluorescent X-ray generated from the metal species of the metal salt is prepared. After that a sample of toner to be subjected to measurement of the content of the metal salt coagulating agent is formed to a pellet in the same manner as above, and the intensity of fluorescent X-ray from the metal species of the metal salt coagulating agent is measured, and the content or the remaining amount of metal ion in the toner can be determined according to the above calibration curve.

<Wax>

The toner obtained by the above-described processes is a toner having a sea-island structure formed by fusing the resin particles including wax in the aqueous medium and suitably coagulating the wax by the ripening process. The toner in which the wax is finely dispersed can be obtained by salting out/fusing thus formed resin particles including wax with the colorant particles in the aqueous medium.

As the wax having a releasing function, low molecular weight polypropylene having a number average molecular weight of from 1,500 to 9,000 or low molecular weight polyethylene is preferable, and an ester type compound represented by the following formula is particularly preferable.

$$R_1—(OCO—R_2)_n$$

In the formula, n is an integer of form 1 to 4, preferably from 2 to 4, and more preferably 3 or 4. $R_1$ and $R_2$ are each a hydrocarbon group which may have a substituent. The number of the carbon atoms of the group represented by $R_1$ is from 1 to 40, preferably from 1 to 20, and more preferably from 2 to 5. The number of the carbon atoms of the group represented by $R_2$ is from 1 to 40, preferably from 16 to 30, and more preferably from 18 to 26.

Examples if typical compound are listed below.

1) $CH_3-(CH_2)_{12}-COO-(CH_2)_{17}-CH_3$

2) $CH_3-(CH_2)_{18}-COO-(CH_2)_{17}-CH_3$

3) $CH_3-(CH_2)_{20}-COO-(CH_2)_{17}-CH_3$

4) $CH_3-(CH_2)_{14}-COO-(CH_2)_{19}-CH_3$

5) $CH_3-(CH_2)_{20}-COO-(CH_2)_6-O-CO-(CH_2)_{20}-CH_3$

6) $CH_3-(CH_2)_{20}-COO-(CH_2)_2-CH(CH_3)-CH_2-O-CO-(CH_2)_{20}-CH_3$

7) $CH_3-(CH_2)_{22}-COO-(CH_2)_2-CH(CH_3)-CH_2-O-CO-(CH_2)_{22}-CH_3$

8) $CH_3-(CH_2)_{22}-COO-CH_2-C(CH_3)_2-CH_2-O-CO-(CH_2)_{22}-CH_3$

9) $CH_3-(CH_2)_{26}-COO-CH_2-C(CH_3)_2-CH_2-O-CO-(CH_2)_{26}-CH_3$

10) $CH_2-O-CO-(CH_2)_{26}-CH_3$
$CH-O-CO-(CH_2)_{26}-CH_3$
$CH_2-O-CO-(CH_2)_{26}-CH_3$

11) $CH_2-O-CO-(CH_2)_{22}-CH_3$
$CH-O-CO-(CH_2)_{22}-CH_3$
$CH_2-O-CO-(CH_2)_{22}-CH_3$

12) $CH_2-OH$
$CH-O-CO-(CH_2)_{26}-CH_3$
$CH_2-O-CO-(CH_2)_{26}-CH_3$

13) $CH_2-OH$
$CH-O-CO-(CH_2)_{22}-CH_3$
$CH_2-O-CO-(CH_2)_{22}-CH_3$

14) $CH_2-OH$
$CH-OH$
$CH_2-O-CO-(CH_2)_{26}-CH_3$

15) $CH_2-OH$
$CH-OH$
$CH_2-O-CO-(CH_2)_{22}-CH_3$

-continued

16) $CH_3-(CH_2)_{26}-COO-CH_2-C(CH_3)(CH_2-O-CO-(CH_2)_{26}-CH_3)_2-CH_2-O-CO-(CH_2)_{26}-CH_3$

17) $CH_3-(CH_2)_{20}-COO-CH_2-C(CH_2CH_3)(CH_2-O-CO-(CH_2)_{20}-CH_3)_2-CH_2-O-CO-(CH_2)_{20}-CH_3$

18) $CH_3-(CH_2)_{26}-COO-CH_2-C(CH_2-O-CO-(CH_2)_{26}-CH_3)_3-CH_2-O-CO-(CH_2)_{26}-CH_3$

19) $CH_3-(CH_2)_{20}-COO-CH_2-C(CH_2-O-CO-(CH_2)_{20}-CH_3)_3-CH_2-O-CO-(CH_2)_{20}-CH_3$

20) $CH_3-(CH_2)_{18}-COO-CH_2-C(CH_2-O-CO-(CH_2)_{18}-CH_3)_3-CH_2-O-CO-(CH_2)_{18}-CH_3$

21) $CH_3-(CH_2)_{16}-COO-CH_2-C(CH_2-O-CO-(CH_2)_{16}-CH_3)_3-CH_2-O-CO-(CH_2)_{16}-CH_3$

22) $CH_3-(CH_2)_{20}-COO-CH_2-C(CH_2-O-CO-CH_3)_3-CH_2-O-CO-CH_3$

The adding amount of the wax is from 10 to 30%, and preferably from 12 to 25%, by weight of the entire toner weight.

When the adding amount is less than 10%, the offset tends to occur.

(6) Image Forming Apparatus

Figure 5:
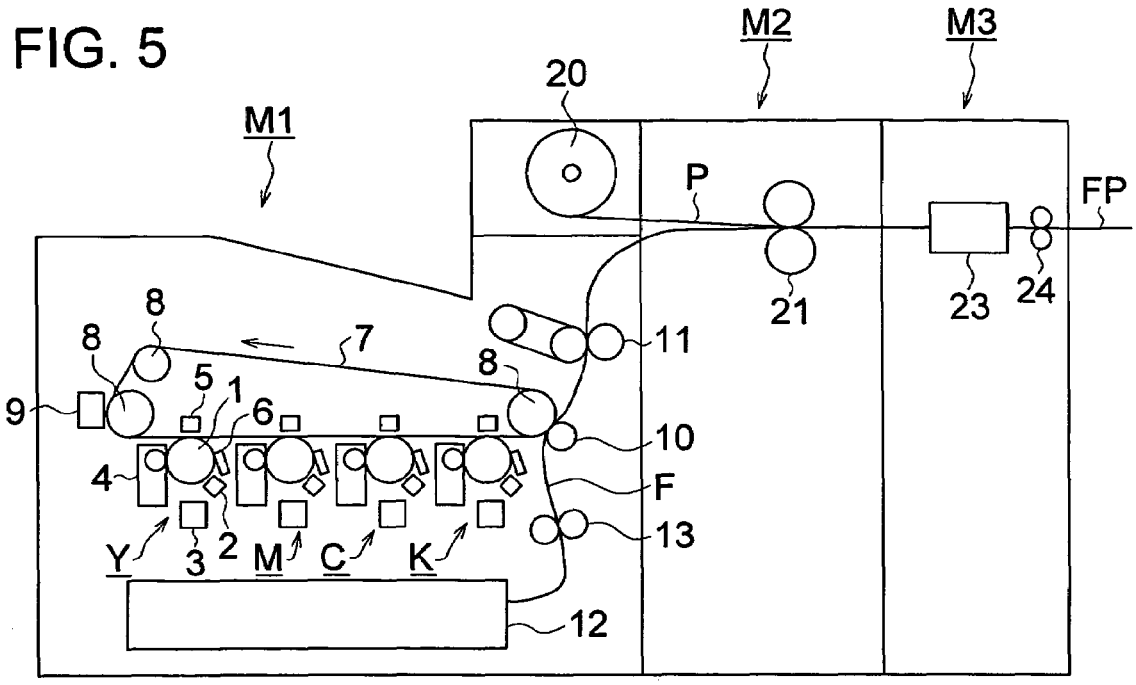
FIG. 5 shows a color image forming apparatus as the first example of the embodiment of the invention.

FIG. 5 shows the first example of the color image forming apparatus relating to the embodiment of the invention.

The color image forming apparatus comprises an image forming section M1, a laminating section M2 and cutting section M3.

The image forming section has an image forming unit Y for forming a yellow toner image, an image forming unit M for forming a magenta toner image, an image forming unit C for forming a cyan toner image, and an image forming unit K for forming a black toner image.

The image forming apparatus Y, M, C and K are the same in the structure thereof. Therefore, signs for indicating the constituting parts are only provided on the yellow image forming unit Y and signs on the other image forming units are omitted, and though the action of the yellow image forming unit Y is only described, the actions of the image forming units M, C and K are the same as that of the image forming unit Y.

A charging means 2, an exposing means 3, a developing means 4, a primary transfer means 5 and a cleaning means 6 are arranged around a drum-shaped photoreceptor 1.

On the occasion of image formation, the photoreceptor 1 is rotated clockwise, and an electrostatic latent image is formed on the photoreceptor 1 by charging by the charging means 2 and exposing by the exposing means 3. The resultant electrostatic latent image is developed by the developing means 4 so that a toner image is formed on the photoreceptor 1.

The toner image on the photoreceptor 1 is transferred onto an intermediate transfer member 7 by the primary transfer means 5.

On the intermediate transfer member 7 which is laid by stretching by plural rollers 8 and moved in the direction of the arrow sign, a yellow toner image formed by the yellow image forming unit Y, a magenta toner image formed by the magenta image forming unit M, a cyan toner image formed by the cyan image forming unit C, and a black toner image formed by the black image forming unit K are transferred and superimposed so as to form a multi-color toner image.

The multi-color toner image on the intermediate transfer member 7 is transferred onto a sheet of transfer film F by a secondary transfer means 10.

The transparent film F is stored in a cassette 12 and supplied one by one by a supplying roller 13.

As the charging means 2, a scorotron charging device having a discharging electrode and a grid is preferably employed.

As the exposing means 3, an exposing device emitting light according to the image date for dot exposing the photoreceptor is preferable, and a laser scanning exposing device and a LED alley exposing device are preferably employed.

The developing means 4 is preferably a developing device for performing reversal development by using a double-component mainly composed of the above-described wax-including toner according to the invention and a carrier.

As the primary transfer means 5 and the secondary transfer means 10, a transfer roller to which transfer voltage is applied, or a corotron charging device having a discharging electrode is preferably employed.

The cleaning means 6 and 9 are preferably a blade cleaning device employing an elastic blade.

As the fixing means 11, the above-described fixing means is employed.

The transparent film F carrying the transferred multi-color toner image is fixed by passing through the fixing means 11 and then output from the image forming section M1 and conveyed to the laminating section. In the laminating section, roll-shaped paper P as the light reflecting material is piled with the transparent film F and passed through the nip of a pressing roller pair 21. A layer of a tacking agent of an adhesive is previously provided on the paper P as the light reflecting material, and the transparent film F and the paper P are laminated by adhering or tacking. The adhesion or tack is carried out by pressing or heating with pressure by a pair of pressing roller 21.

The laminated object or a print FP is conveyed to the cutting section M3 and cut into sheet-shaped print by a cutter 23 and output from the cutting section M3.

Figure 6:
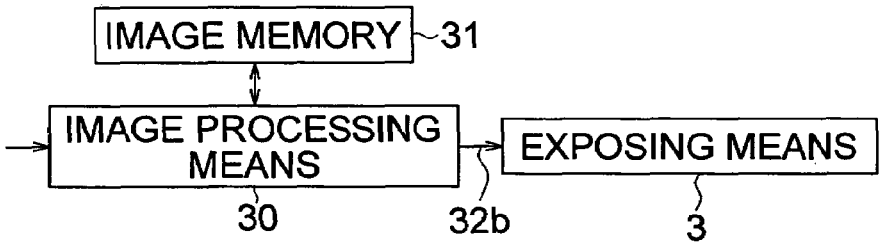
FIG. 6 shows a block drawing of an image processing means.
Figure 7:
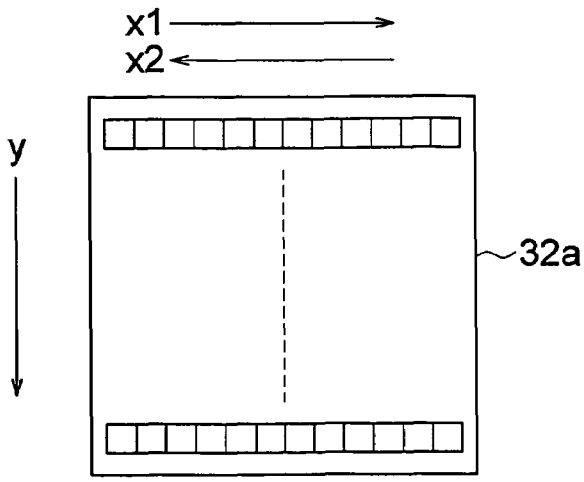
FIG. 7 shows a drawing describing the reading out of image data from an image memory.

In each of the image forming units Y, M, C and K, the exposure is carried out by the exposing device 3 so that a mirror image is formed on the photoreceptor 1. The mirror image is formed by image processing by an image processing means shown in FIGS. 6 and 7. FIG. 6 shows the image processing means for forming the mirror image.

An image processing means 30 for forming data for driving the exposing means 3 reads out the image data from an image memory 31 and forms image data 32*b*. When the mirror image is to be formed, the image processing means 30 reads out image date 32*a* memorized in the image memory 31 in order x2 reverse to the writing order x1 in the scanning direction and in the writing order y in the sub-scanning direction to form the image date 32*b*.

The mirror image formed on the photoreceptor 1 is made to a right image on the intermediate transfer member 7, and converted to the mirror image by transferring onto the transparent film F.

The mirror image formed on the transparent film F is observed as the right image when the print FP prepared by laminating the transparent film F and the paper P.

FIG. 8 shows the second example of the embodiment of a color image forming apparatus.

The image forming section has an image forming unit Y for forming a yellow toner image, an image forming unit M for forming a magenta toner image, an image forming unit C for forming a cyan toner image, and an image forming unit K for forming a black toner image.

The image forming apparatus Y, M, C and K are the same in the structure thereof. Therefore, signs for indicating the constituting parts are only provided on the yellow image forming unit Y and signs on are omitted, and though the action of the yellow image forming unit Y is only described, the actions of the image forming units M, C and K are the same as that of the image forming unit Y.

A charging means 2, an exposing means 3, a developing means 4, a primary transfer means 5 and a cleaning means 6 are arranged around a drum-shaped photoreceptor 1.

On the occasion of image formation, the photoreceptor 1 is rotated clockwise, and an electrostatic latent image is formed on the photoreceptor 1 by charging by the charging means 2 and exposing by the exposing means 3. The resultant electrostatic latent image is developed by the developing means 4 so that a toner image is formed on the photoreceptor The toner image on the photoreceptor 1 is transferred onto an intermediate transfer member 7 by the primary transfer means 5.

A yellow toner image formed in the yellow image forming unit Y, a magenta toner image formed in the magenta image forming unit M, a cyan toner image formed in the cyan image forming unit C, and a black toner image formed in the black image forming unit K are transferred in layers onto the transparent film F so as to form a multi-color toner image.

The transparent film F on which the multi-color toner image is formed is passed through a fixing means 11 for fixing the multi-color toner image and conveyed to pressing roller pair 21. Besides, paper P having a tacking layer or an adhering layer is supplied from a bulk roller 20 and overlapped with the transparent film F at a pressing roller. The transparent film F is overlapped with the paper P supplied from the bulk roller 20 and laminated by passing through the pressing roller pair 21 to form a print FP. The print FP is cut by a cutter 23 into a designated size.

In this example, a right toner image of the original image is formed on the photoreceptor 1 by the exposing means 3, and a mirror image is formed on the transparent film F.

The mirror image is backed by the paper P to prepare a photograph which is viewed as a right image by viewing from the side reverse to the image carrying surface of the transparent film F.

In this example, an image processing means 30 shown in FIG. 6 reads out image date from an image memory 31 in the order the same as that of writing x1 to form image data 32*b* by which the exposing means 3 is driven.

Figure 9:
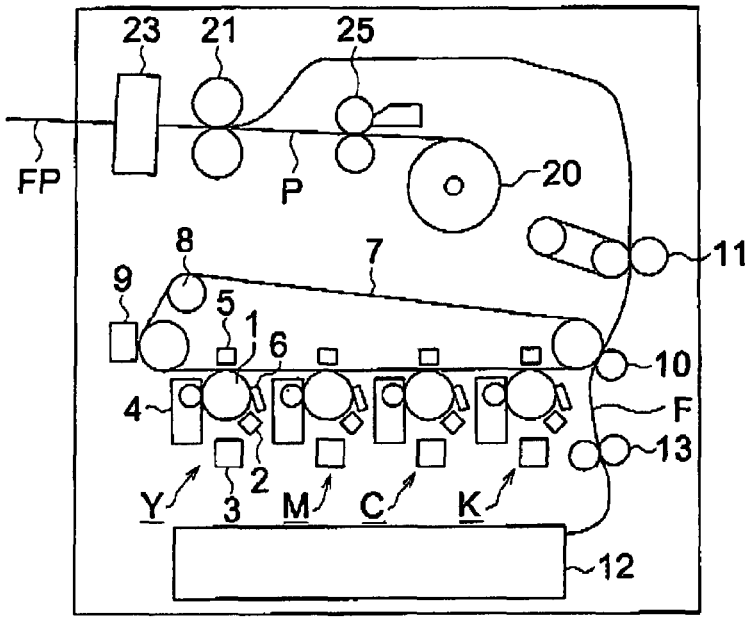
FIG. 9 shows a color image forming apparatus as the third example of the embodiment of the invention.

FIG. 9 shows the third example of color image forming apparatus of the embodiment of the invention.

The image forming section of this embodiment has a structured the same as that in the embodiment 1.

This embodiment is different form the embodiment 1 in that the laminating section M2 is omitted and the laminated means is built in the image forming section together with an adhesive coating means.

The transparent film F on which a multi-color toner image is formed by the above-described image forming processes is fixed by a fixing device 11 and passed through a pressing roller pair 21. And then a tacking agent or an adhering agent is coated by a coating means 25 on the surface of the transparent film F to be faced to paper P supplied from a bulk roll 20. The transparent film F and the paper P are laminated by the pressing roller pair 21 and cut into a size designated by customers by a cutter 23.

By the above constitution, an image having no irregular surface caused by the toner image can be formed, and the transparent substrate forming the surface layer and the light reflecting material forming the backing layer are strongly bonded with together in thus prepared image. Therefore, a print can be prepared in which the peeling or slipping between the surface layer and the backing layer is extremely small. Thus obtained print is suitable for a print of photograph.

What is claimed is:

1. An image forming method comprising the steps of a) forming a mirror image by a toner containing wax on a transparent substrate, b) fixing the toner image to the transparent substrate without coating any releasing agent, and c) laminating the toner image carrying surface of the transparent substrate with a light reflecting material by putting a tacking layer or an adhering layer between the light reflecting material and the transparent substrate.

2. The image forming method of claim 1, wherein the toner is produced by a wet method.

3. The image forming method of claim 2, wherein the toner is produced by a polymerization method.

4. The image forming method of claim 3, wherein the toner is produced by an emulsion polymerization method.

5. The image forming method of claim 1, wherein wax is substantially not exposed to the surface of the toner.

6. The image forming method of claim 5, wherein not less than 90% of a particle surface is occupied by a component other than the wax.

7. The image forming method of claim 1, wherein a content of the wax in the toner is from 10% to 30%.

8. The image forming method of claim 7, wherein the content of the wax in the toner is from 12% to 25%.

9. The image forming method of claim 1, wherein the light reflecting material previously has the tacking or adhering layer.

10. The image forming method of claim 9, wherein the light reflecting material is coated paper and a coated layer on the coated paper has the tacking or adhering layer.

11. The image forming method of claim 1, wherein the toner contains a color toner and the toner image is a multi-color toner image that plural color toner images each different in the color from each other are superposed.

12. The image forming method of claim 1, wherein the light reflecting material is at least one of white, milk-white or silver colored paper or resin film.

13. The image forming method of claim 1, wherein the transparent substrate is resin film.

14. The image forming method of claim 1 wherein the mirror image of the toner is formed on the transparent substrate by an electrophotographic method.

15. A printed material formed by the image forming method of claim 1.

16. An image forming apparatus by an electrophotographic process comprising an image forming section for forming a mirror image by a toner containing wax, a fixing means for fixing the toner image onto a transparent substrate without coating any releasing agent, and a laminating section for laminating a light reflecting material onto the toner image carrying surface of the transparent substrate.

17. The image forming apparatus of claim 16, wherein the image forming section forms the toner image employing a toner containing wax produced by a wet method.

18. The image forming apparatus of claim 16, wherein the image forming section forms the toner image by employing a toner in which the wax is substantially not exposed on a surface of the toner.

19. The image forming apparatus of claim 16, wherein the fixing means has a heating member and a pressing member, and fixes the toner image to the transparent substrate by nipping and conveying without coating any releasing agent onto the heating member.

20. The image forming apparatus of claim 19, wherein the fixing means has a cleaning means for removing the wax adhering on the heating member.

21. The image forming apparatus of claim 16, wherein the image forming apparatus has a coating means for coating a tacking agent or an adhering agent for tacking or adhering the light reflecting material onto the transparent substrate.

22. The image forming apparatus of claim 16, wherein the image forming section has a plurality of image forming units for forming a multi-color toner image superposed by layered plural color images.

* * * * *